US006393993B1

(12) United States Patent
Reese

(10) Patent No.: US 6,393,993 B1
(45) Date of Patent: May 28, 2002

(54) TRANSIT SWITCHING SYSTEM FOR MONORAIL VEHICLES

(76) Inventor: Eugene A. Reese, 2001 Quail Ridge Rd., Raleigh, NC (US) 27609

( * ) Notice: Subject to any disclaimer, the term of this patent is extended or adjusted under 35 U.S.C. 154(b) by 0 days.

(21) Appl. No.: 09/741,934

(22) Filed: Dec. 20, 2000

(51) Int. Cl.[7] ..... E01B 25/06

(52) U.S. Cl. ..... 104/130.1; 104/130.4; 104/139; 104/140

(58) Field of Search ..... 104/130.01, 130.04, 104/130.06, 130.07, 130.08, 139, 140, 141; 105/30

(56) References Cited

U.S. PATENT DOCUMENTS 3,640,227 A * 2/1972 Webb ..... 104/130
3,791,308 A * 2/1974 Hartz ..... 104/139
3,838,648 A * 10/1974 Dahlberg et al. ..... 104/139
4,089,270 A * 5/1978 Blake ..... 104/130
4,671,185 A * 6/1987 Anderson et al. ..... 104/130

FOREIGN PATENT DOCUMENTS

JP 54057715 A * 5/1979
JP 354057715 A * 5/1979

* cited by examiner

*Primary Examiner*—S. Joseph Morano
*Assistant Examiner*—Frantz F. Jules
(74) *Attorney, Agent, or Firm*—Mills Law Firm PLLC

(57) ABSTRACT

A monorail switching system for guided vehicles includes a main guideway mounted below the transportation monorail that engages a vertically shiftable keel assembly carried by the vehicle. For entrance/exit junctions, a secondary guideway defines the junction path is selectively engaged by lowering the shiftable keel from control by the main guideway. The plural guideways permit vehicles to travel in concert notwithstanding selective revision at the junctions.

13 Claims, 6 Drawing Sheets

TRANSIT SWITCHING SYSTEM FOR MONORAIL VEHICLES

FIELD OF THE INVENTION

The present invention relates to track systems for vehicles and, in particular, a switching system for individually and selectively routing vehicles between a main track and merged tracks on a dedicated route.

BACKGROUND OF THE INVENTION

Dedicated railed routing systems have been proposed for coordinating travel of vehicles along tracked paths. Frequently proposed systems include monorails, fixed rails, magnetic levitation systems and the like wherein all vehicles travel in synchrony along a main transit path and are merged thereto and therefrom for mass or individual entry or egress. One of the significant problems encountered in such approaches in maintaining traffic flow under merging conditions. Inasmuch as it is beneficial to maintain the traveling vehicles in close array for optimum traffic density and speed, safe and efficient entry and exit is of prime importance. Heretofore, it has been necessary to alter traffic flow on the main path to permit the discrete vehicle to enter or leave. This has required slowing traffic speeds at such points and providing sufficient vehicle spacing to permit the safe routing of the intended vehicle without inadvertently effecting proximate vehicles. Moreover during such traffic handling it is important that the routed vehicle remain stable under affirmative steering control.

For example, U.S. Pat. No. 889,441 to Christopher discloses a railway switch wherein a tracked vehicle selectively engages a ramp in advance of a turn off to shift mechanically track tongues to a position prescribing a divergent path. Such mechanical mechanism is slow acting and must be mechanically returned to the original position to avoid inadvertently affecting following traffic.

U.S. Pat. No. 3,363,584 to Brush et al. discloses a vehicle control system wherein one side of the vehicle is controlled by a rail system for main traffic routing and the opposed side of the vehicle is controlled by a second rail system to route the vehicle for egress and entry. Control requires alternative selective shifting for engaging the desired path and disengaging the prior path.

U.S. Pat. No. 3,451,351 to Hawes discloses a monorail switching system wherein laterally spaced guide rollers are selectively deployed to transfer steering and routing control between a main path and a transfer path. A similar system is disclosed in U.S. Pat. No. 3,593,668 to Adams wherein selectively lowered guide wheels are switched prior to a junction between a main channel and a transfer channel for electively steering a tracked vehicle at a transfer point.

U.S. Pat. No. 3,595,173 to Giraud discloses a roof plate on a vehicle that is raised to selectively engage a merging ramp for vertically routing a vehicle at a transfer junction.

U.S. Pat. No. 3,628,462 to hit discloses a vehicle switching apparatus wherein pivoting rollers on the vehicle are alternatively deployed for switching between a main path and a transfer path.

U.S. Pat. No. 3,640,227 to Webb discloses a suspended rail car system wherein swinging support rollers are selectively deployed between a main path and a divergent path for controlling the course of the car.

U.S. Pat. No. 3,838,648 to Dahlberg et al. discloses a transportation system wherein the vehicle selectively traverses ramped surfaces a divergent transfer points.

U.S. Pat. No. 4,092,931 to Wulf et al. discloses a guide mechanism for vehicles wherein steering control on a fixed path is provided by longitudinally spaced guide wheels engage a guide channel for controlled routing of the vehicle.

U.S. Pat. No. 5,016,542 to Mitchell discloses a transit system wherein hydraulically operated vanes are selectively deployed for routing a vehicle between a main line and a station.

The foregoing, while providing merging capabilities, require excessive vehicle separation in operation. Additionally, the systems do not provide for affirmative directional control of the vehicle during such maneuvers. Further, many of the systems do not readily adapt to incorporation with passenger vehicles in high speed applications requiring stable steering control during merging conditions.

In view of the above limitations, it is an object of the present invention to provide a switching system for tracked vehicles that is selectively deployed for entering tracked transit and for accessing merging conditions.

Another object of the invention is to provide a steering system for transit vehicles that retain affirmative tracking control during non-linear movement.

A further object of the invention is to provide a keel assembly for a transit vehicle that is selectively engagable with a track system for steering the vehicle during travel and merger conditions with minimum spacing between vehicles.

Yet another object of the invention is to provide a tracking system for vehicles that is selectively engaged by a steering keel deployed from the vehicle for affirmatively prescribing travel and merger operation.

SUMMARY OF THE INVENTION

The foregoing objects are accomplished by a monorail switching system for guided vehicles having a main guideway mounted below the transportation monorail that is selectively engaged a vertically shiftable elongated keel assembly deployed by the vehicle. For entrance/exit junctions, a secondary guideway below the main guideways defines the junction path and may be selectively engaged by lowering the keel assembly at a joint transition zone prior to the transfer route. The plural guideways permit vehicles to travel in concert notwithstanding selective revision at the junctions.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
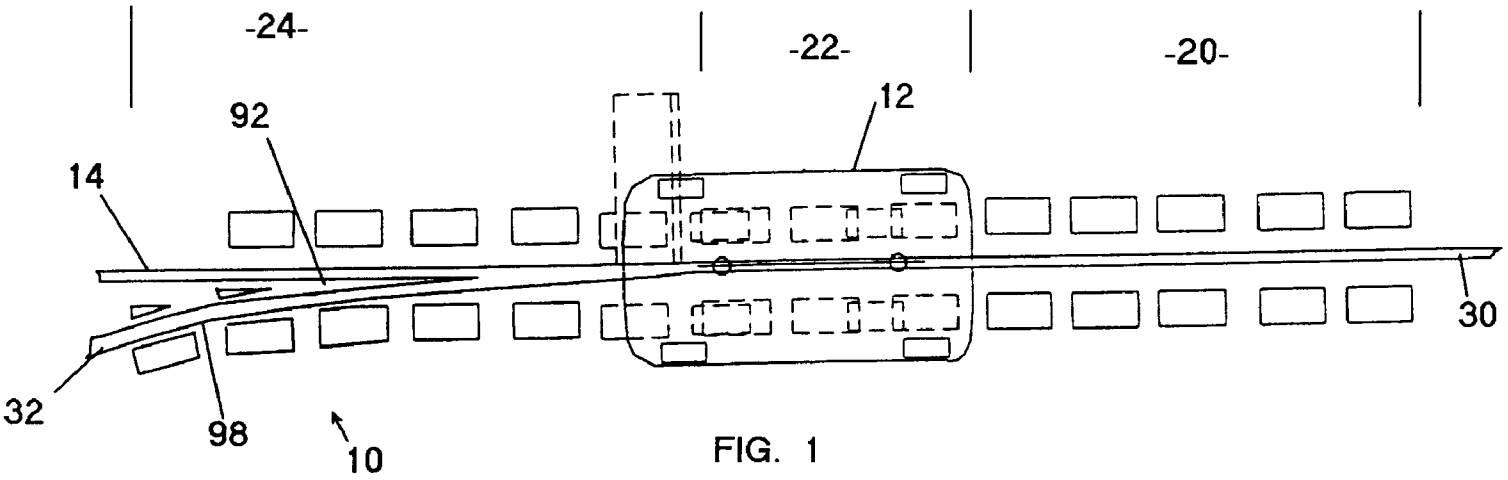
FIG. 1 is plan view of a transit switching system in accordance with an embodiment of the invention showing a guided vehicle at a departure transfer junction.
Figure 2:
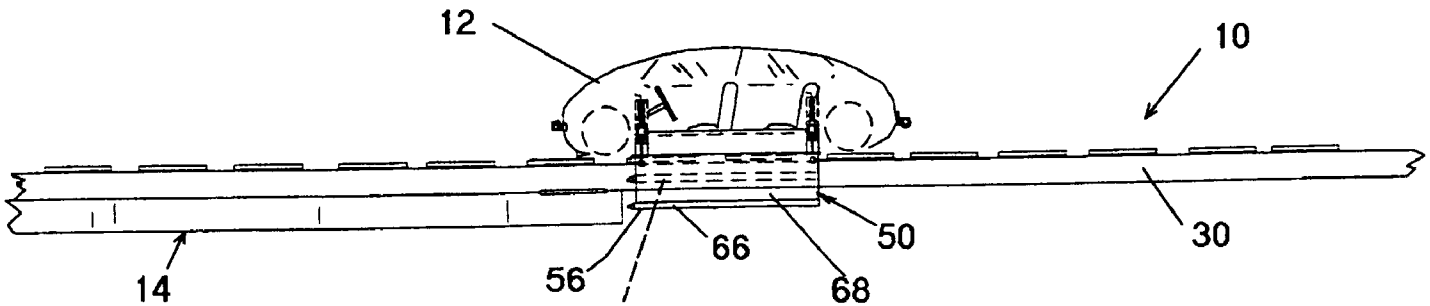
FIG. 2 is a side elevational view of the transit switching system shown in FIG. 1.

Referring to the drawings for the purpose of describing the preferred embodiment and not for limiting same, FIGS. 1 and 2 illustrate a transit system 10 for routing vehicles 12 along a prescribed track switching system 14 under the control of a keel guide system 16. The transit system 10, as will hereinafter become apparent, may handle passenger or commercial vehicles along conventional surfaces or adapted vehicles along fixed guide paths, such a well known monorail-type system of either supported or suspended architecture. Further, the propulsion for such vehicles may be conventional power plants, linear magnetic levitation systems, or the like. The transit system will be described and illustrated with respect to a magnetic levitation system.

In such systems, the track system 14 prescribes forwardly directed main sections 20 for transiting vehicles, singularly or in concert with other vehicles, between spaced locations, and transition sections 22 for prescribing entry to or departure from the main sections 20 preparatory to a transfer junction 24. During such movement along the track system, the vehicles may be individually controlled or alternatively and preferably cojointly controlled by a centralized system.

Figure 3:
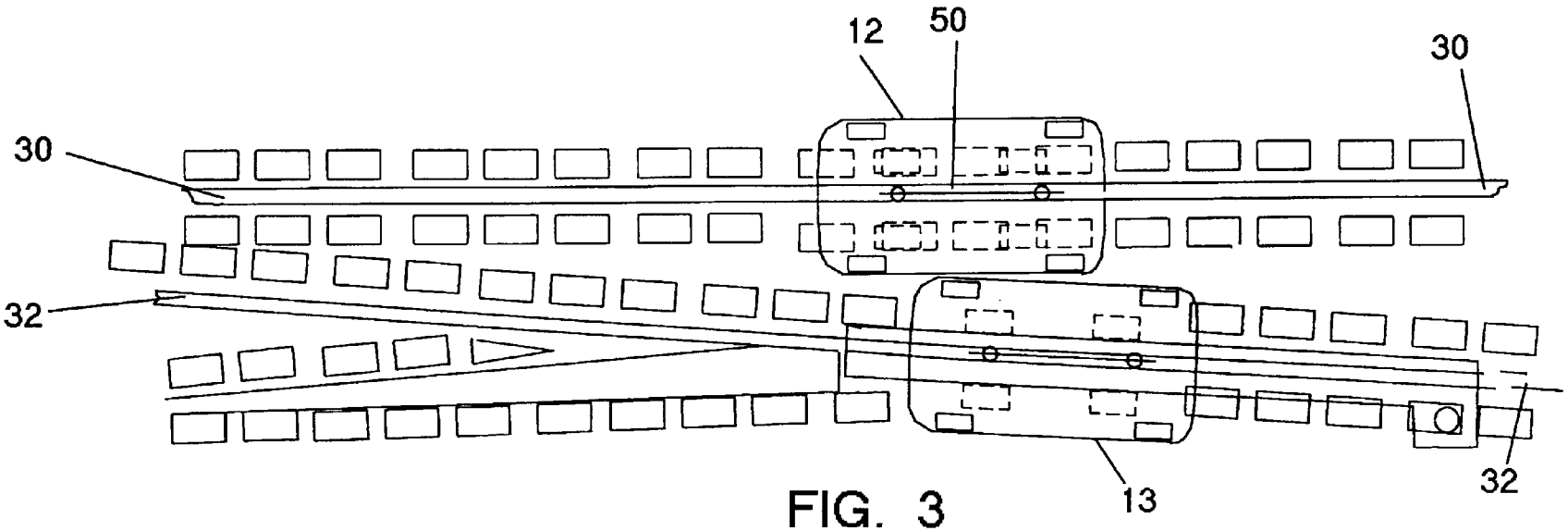
FIG. 3 is a plan view of the transit switching system showing a guided vehicle at an entry transfer junction.
Figure 4:
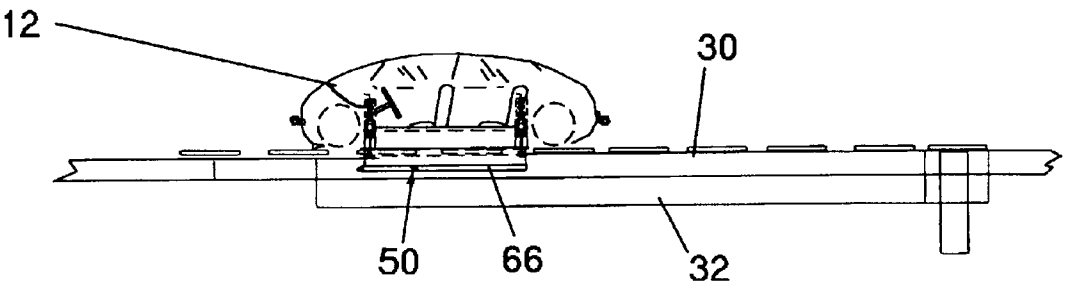
FIG. 4 is a side elevational view of the vehicle at the merger transfer junction of FIG. 3.
Figure 12:
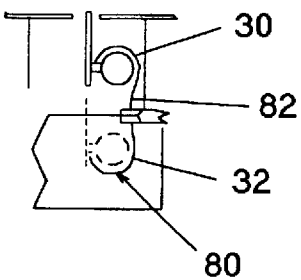
FIG. 12 is a schematic view of the keel assembly at the transition section.
Figure 10:
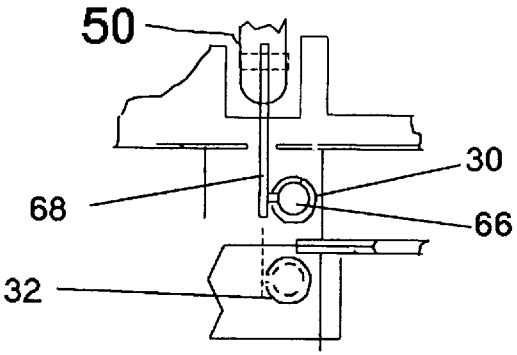
FIG. 10 is a schematic view of the keel assembly in the main transit position.
Figure 11:
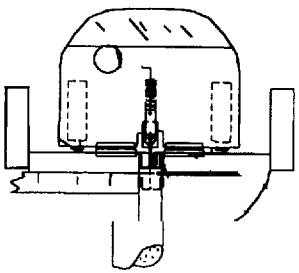
FIG. 11 is a schematic view of the guided vehicle on the transit system.

The main section 20 comprises a main upper guide way 30 supported at spaced locations along the length thereof. The transition section 22 as shown in FIG. 12 comprises a secondary lower guide way 32 supported vertically below the upper guide way 30. The transition section 22 forms a plural guideway intermediate the main upper guideway 30 and the lower guideway 32 enabling the vehicle 12 to selectively route therebetween. The transition thus comprises an upper guide path forming a continuation of the upper guideway 30 and a lower guide path forming a continuation of the lower guideway 32. The upper guide path and the lower guide path in the transition section communicate at transition slot 40. As shown in FIGS. 3 and 4, the track system in mirror image provides plural guide paths for accommodating merger of vehicles 13 from right to left, as illustrated, at entry sections 42 for merger with vehicles traveling along the main section 20.

Figure 5:
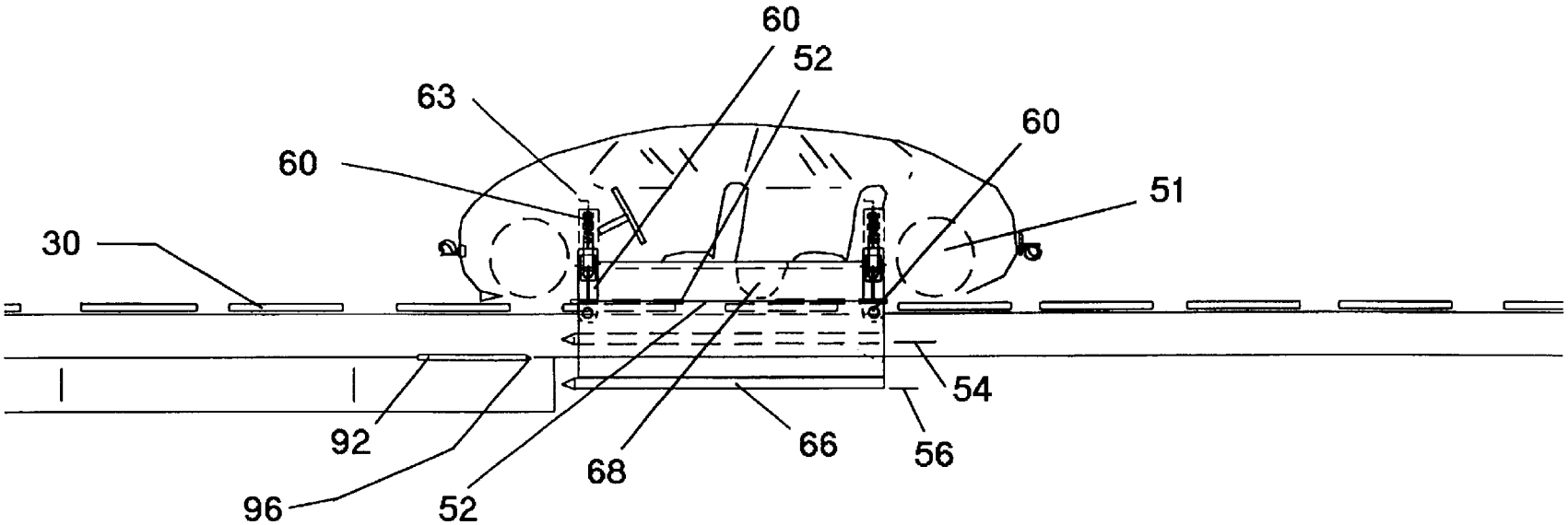
FIG. 5 is an enlarged side elevational view of the vehicle of FIG. 1 at the departure transfer junction.

Referring to FIGS. 2 and 5, the vehicle 12 is provided with a retractable keel system 50 that may be selectively vertically positioned between an upper neutral position 52 above the traveling surface with the wheels 51 in a lowered for conventional propulsion, a first lowered position 54 coacting with the upper guideway 30 for controlling the vehicle with respect to the surface on the main roadway, and a second lowered position 56 coacting with the lower guideway 32 in the transition section 22 and the transfer section 24, the wheels being in the illustrated raised positions.

The keel system 50 is supported by front and read guides 60 as positioned by actuator 62 or crank 63 under the control of the vehicle driver or a computerized control system. The keel system 50 is downwardly biased by spring 64. The keel system 50 comprises an elongate bullet-shaped keel 66 laterally attached to a support plate 68 by pins 70 and slidably supported by the guides 60. In the lowered positions 54, 56 the keel 66 is slidably conformably supported by the guideways 30, 32, respectively.

As illustrated, the keel 66 has a substantially cylindrical shape bounded by the guideways 30. The guideways have a generally C-shaped cross section including an arcuate shell 70 and a lateral longitudinal slot 72 through which the pins 73 project for connection with the support plate 68. The keel 66 has an extended length slightly less than the wheelbase of the vehicle. The keel 66 may be mechanically, magnetically, roller supported or otherwise slidably constrained by the guides. Accordingly, the curvatures of the guideways will impart a steering force to the keel 66 and thereby to the vehicle whereby the latter will be properly oriented in the traffic lanes.

During main portions of the main section 20, only the main guideway 30 is required. At the transition section as shown in FIG. 12, the guideway 80 comprises dual guiding shapes for the keel in both operative positions and during movement therebetween. This is effected by utilizing the top and bottom walls of the upper and lower guideways respective with a generally planar interconnecting wall 82. During vehicle travel at the transition section, the operator may deploy the keel 66 between the positions and during such movement the interconnecting wall 82 will impart the steering control.

Figure 13:
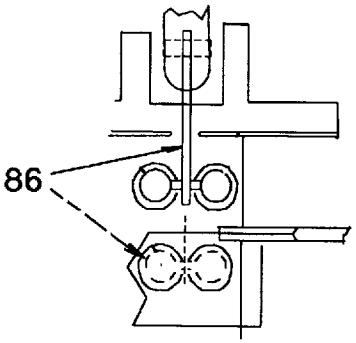
FIG. 13 is a schematic view of an embodiment of the keel assembly.

Adjacent the transfer section, the full contour of the lower guideway 32 is established for placing the vehicle under control of the interaction between the keel 66 and the lower guideway 32. Thus, as the lower guideway diverges from the main guideway, affirmative control of vehicle movement is prescribed by the lower guideway path. In these zones, additional steering constraint may be provided by supplemental guiding contact with the reverse side of the support plate or by symmetrical use of a secondary keel assembly 86 as shown in FIG. 13, to the extent that such additional lateral constraint is desirable or necessary.

Figure 6:
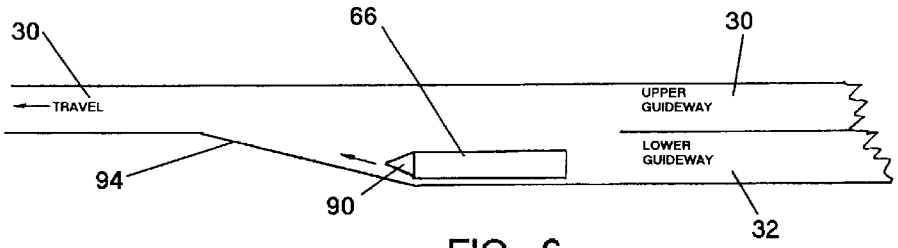
FIG. 6 is a schematic view illustrating the disposition of the keel with respect to the guideways at a merger transfer junction.
Figure 7:
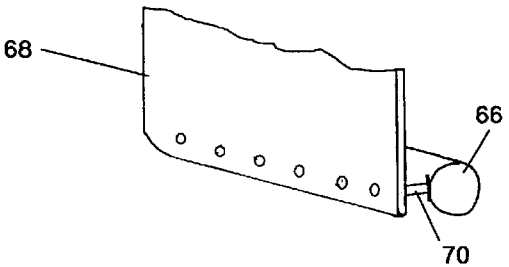
FIG. 7 is a perspective view of the keel assembly for the guided vehicle.
Figure 8:
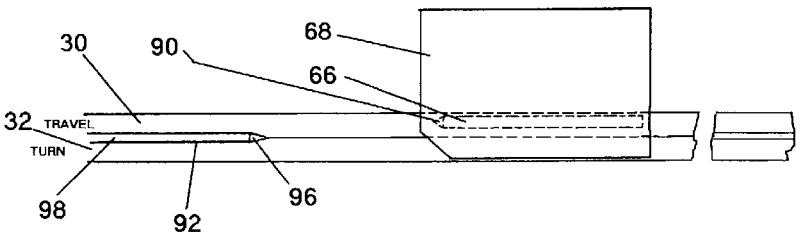
FIG. 8 is a side elevational view of the keel assembly in the main transit position prior to a departure transfer junction.
Figure 9:
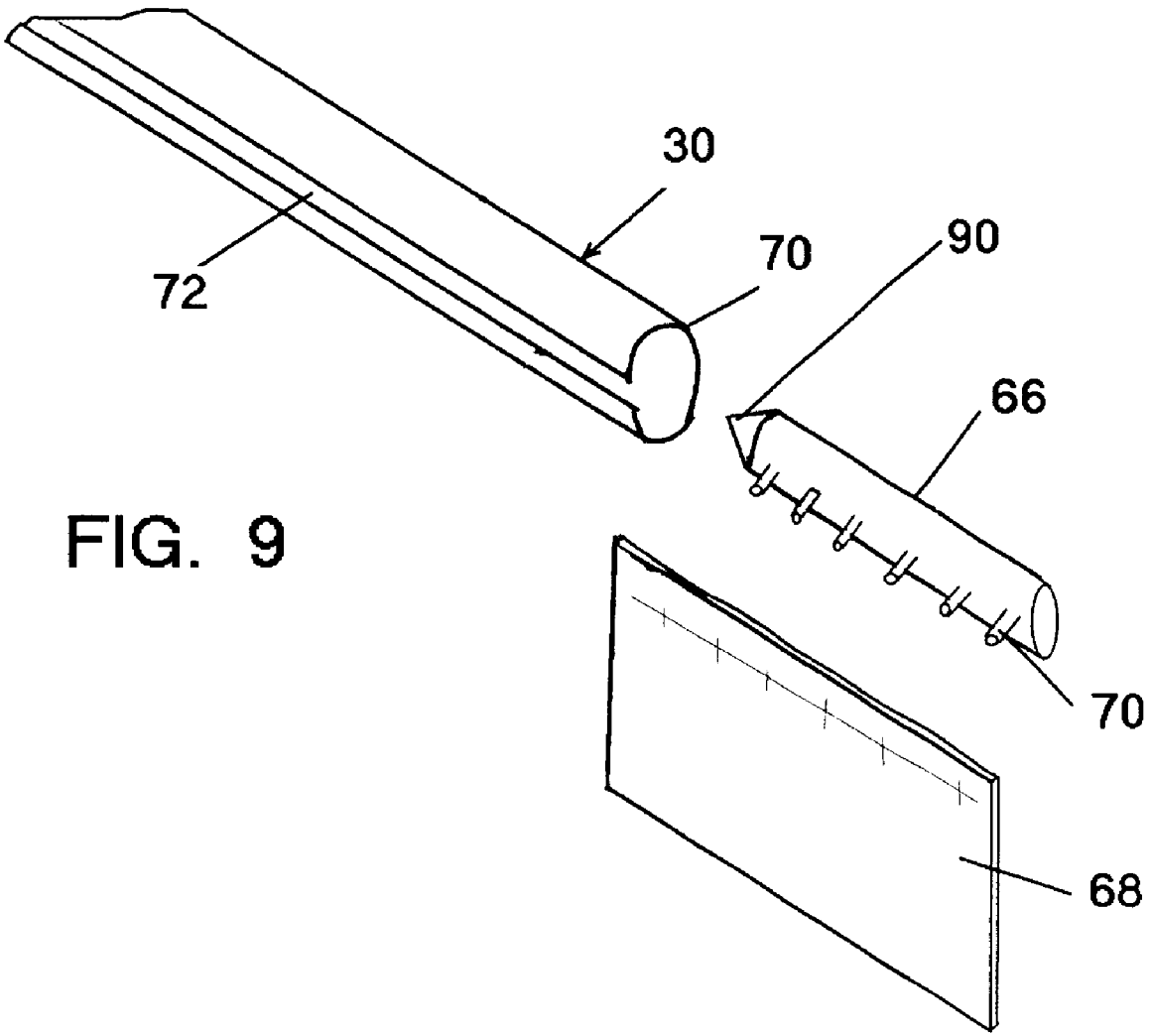
FIG. 9 is an exploded perspective view of the keel assembly and guideway.

In order to further improve tracking, the transit system is provided with a conical alignment tip 90 on the leading end of the keel 60. As shown in FIG. 8, the tip 90 may coact with a wedge shaped frog 92 located intermediate the upper guideway and the lower guideway at the intersection of the transition section and the transfer section. In this manner, if there is a slight misalignment in the selected position, the tip will center the keel 66 in the appropriate guideway. Further as shown in FIG. 6, the alignment tip 90 may engage a transition ramp 94 at a merging junction for establishing registration with the desired guideway. The alignment tip 90 is generally conical or otherwise tapered to provide a minimal frontal projection. The facing edges 96 of the frog 92 are similarly rearwardly outwardly flared. Accordingly, in the event the keel 66 is not completely aligned with the desired continuation path in the lower guideway, the surfaces of the alignment tip and the facing edges 96 of the frog 92 coact to bias vertically the keel 66 into the fully aligned condition. Further, as shown in FIG. 1, the trailing surfaces 98 of the frog interact with the keel 66 and support plate to provide affirmative routing along the intended course.

At the termination of the transfer section, sufficient length is provided for deceleration of the vehicle at a station or transfer point, or redeployment of the wheels to permit conventional travel on regular road surfaces.

The tracking system of the present invention has been described with reference to magnetic levitation/propulsion systems. Such as system will permit the transiting vehicles to travel at high velocities, alone or in tandem, and to interrelate travel with a central control system. However, it will be appreciated that the tracking system may be employed with other power systems and with modified conventional vehicles. Further it will be appreciated that the tracking system may also be employed for suspended propulsion systems.

The present invention thus provides a routing system for enabling vehicles to travel dedicated, limited access routes in close proximity to other vehicles, while permitting safe individual ingress and egress without disruption of through traffic, or inadvertent switching of leading or trailing vehicles. The system is amenable to various propulsion systems as well as conventional modes. Moreover, various supplement control systems may be utilized for coordination with all vehicles traveling thereover.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. A switching system for vehicles traveling along a main path having a merger path intersecting therewith, said switching system comprising: a vehicle; a first guideway traversing said main path; a second guideway vertically spaced from said first guideway traversing in a transition section said merger path and an adjacent portion of said main path; a keel system on said vehicle having an elongated keel member slidably adapted to be slidably conformably received by said first guideway and said second guideway, said keel member having an elongated body extending along the longitudinal axis of said vehicle; actuator means associated with said keel system for selectively moving said keel member from a neutral position spaced from said main path to a first position coacting with said first guideway and a second position coacting with said second guideway; and slot means in said transition section permitting said keel member to move between said first position and said second position.

2. The switching system as recited in claim 1 wherein elongated body has a cylindrical cross section.

3. The switching system as recited in claim 2 wherein said cylindrical cross section is circular.

4. The switching system as recited in claim 3 wherein said first guideway and said second guideway have a C-shaped cross section slidably retaining said keel member.

5. The switching system as recited in claim 4 wherein said keel member has a flared frontal profile.

6. The switching system as recited in claim 5 wherein said frontal profile is conical.

7. The switching system as recited in claim 1 wherein said keel member is biased from said neutral position.

8. The switching system as recited in claim 1 wherein alignment means are provided at said transition section for coacting with said keel member to mechanically vertically position said keel member in a predetermined guideway.

9. The switching system as recited in claim 8 said alignment means coact with said keel member to mechanically horizontally position said keel member with a predetermined guideway.

10. The switching system as recited in claim 9 wherein said keel assembly includes a pair of laterally spaced keel members.

11. The switching system as recited in claim 1 wherein said keel member extends a substantial portion of the length of said vehicle.

12. The switching system as recited in claim 11 wherein said keel member includes a support plate extending along the length of said vehicle and guide means slidably supporting said support plate for movement from said neutral position to said first position and said second position.

13. A switching system for vehicles traveling between locations along a main path and having a transfer path intersecting said main path for accommodating merger of vehicles between said location, said switching system comprising: a vehicle; a generally C-shaped first guideway traversing said main path; a generally C-shaped second guideway vertically spaced below said first guideway, said second guideway traversing said transfer path and an adjacent portion of said main path; a keel plate vertically slidably supported on said vehicle; an elongated keel member connected to a lower end of said keel plate, said keel member having an elongated cylindrical body slidably disposed within said first guideway and said second guideway; an actuator carried by said vehicle and operative to selectively move said keel member from a raised neutral position within said vehicle to a lowered first position registering with said first guideway and a lowered second position registering with said second guideway; aperture means in said transition section permitting said keel section to move between said first position and said second position: and alignment means associated with said guideways for mechanically biasing said keel member into registry with said guideways.

* * * * *